United States Patent [19]

Krone et al.

[11] 4,227,460

[45] Oct. 14, 1980

[54] PRACTICE WAR HEAD DEVICE

[75] Inventors: Hartmut Krone, Auggen; Rüdiger van Acken, Müllheim; Wolfgang Trede, Weil am Rhein; Robert Schmidlin, Neuenburg, all of Fed. Rep. of Germany

[73] Assignee: Buck Chemisch-Technische Werke GmbH & Co., Bad Reichenhall, Fed. Rep. of Germany

[21] Appl. No.: 926,297

[22] Filed: Jul. 20, 1978

[30] Foreign Application Priority Data

Jul. 26, 1977 [DE] Fed. Rep. of Germany ..... 2733700

[51] Int. Cl.[3] ..... F42B 13/14; F42B 13/44

[52] U.S. Cl. ..... 102/66; 102/6; 102/90; 102/92.7

[58] Field of Search ..... 102/6, 65, 66, 90, 87, 102/90, 76, 92.7

[56] References Cited

U.S. PATENT DOCUMENTS

| | | | |
|---|---|---|---|
| 1,309,772 | 7/1919 | Newell | 102/66 |
| 1,791,716 | 2/1931 | Davis et al. | 102/66 X |
| 3,677,182 | 7/1972 | Peterson | 102/90 X |
| 3,691,952 | 9/1972 | Dee et al. | 102/90 |
| 3,811,381 | 5/1974 | Fichter, Jr. et al. | 102/66 |

FOREIGN PATENT DOCUMENTS

| | | | |
|---|---|---|---|
| 502634 | 5/1920 | France | 102/66 |
| 127031 | 5/1919 | United Kingdom . | |

*Primary Examiner*—Harold J. Tudor

*Attorney, Agent, or Firm*—Toren, McGeady and Stanger

[57] ABSTRACT

The invention concerns a practice war head device for an artillery rocket, comprising a frusto-conical head element having a hollow nose section and a hollow skirt section, an impact detonator mounted in said nose section, a tubular jacket connected to the skirt section, a tubular dividing element concentric with the tubular jacket together defining an annular volume, a fog producing substance based on a carbon halogen or halogen carbohydrate substance and reactive metal or metal oxide powders in said annular volume, and an ignition core of a quick-reacting ignition substance capable of high gas formation in the tubular dividing element, which is characterized in that the fog producing substance is loosely packed in the annular volume, that closure elements closing off said annular volume are provided at the nose side and base side of the annular packing, that at least the nose side closure element is displaceable towards the fog producing substance packing and that the connection between the skirt section of the head element and the tubular jacket, the connection between the central portion of the head element and the tubular dividing element, and the base of the skirt section, are constructed so that upon impact of the war head device, the base of the skirt section will be displaced into the annular volume to thereby compress the fog producing substance.

16 Claims, 1 Drawing Figure

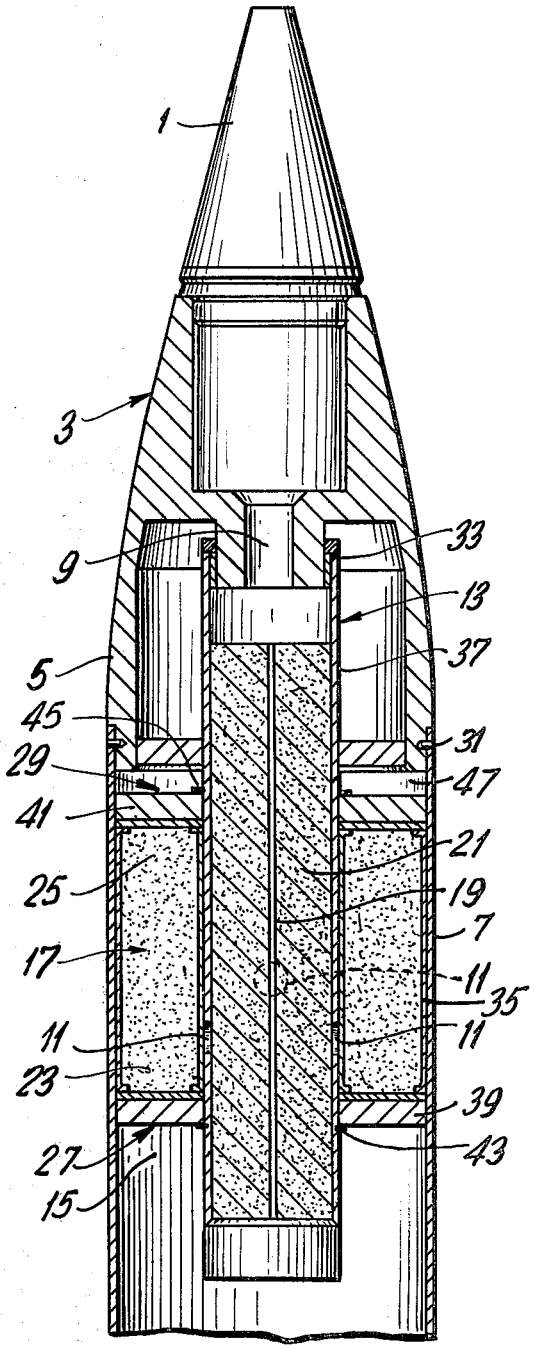
1
3
9
33
13
37
5
45
31
29
47
41
21
25
19
7
17
11
35
11
11
23
39
43
27
15

PRACTICE WAR HEAD DEVICE

BACKGROUND OF THE INVENTION

1. Field of the Invention

This invention relates to the field of fog emitting practice war heads. More particularly, the invention pertains to the field of practice war heads utilizing fog producing substances based on mixtures of carbon halogen or halogen carbohydrate substances and reactive metal or metal oxide powders.

2. Description of the Prior Art

For producing substances based on hexachloroethane and metal powders are known and have been employed in fog devices for years in view of their good fog producing properties. Also known are fog producing substances based on hexachloroethane and metal powders, comprising also a metal oxide as an additional component, for example zinc oxide (Modern Pyrotechnics by Dr. H. Ellern, 1961, page 277). Suitable smoke and fog producing substances are described in British Pat. No. 127 031, in which it is also disclosed that such substances can be ignited, amongst others, by so-called "alumino-thermal" mixtures, which are mixtures of metal powders and oxygen-liberating substances.

As a rule, fog producing substances based on hexachloroethane and metal powders are only shaken loosely into place, since they are sufficiently stable in storage only in loose form. There are however special receptacles available which may be highly compressed. All of these substances packings however require a relatively long time before the fog reaction proceeds at full rate. The time for reaction to commence can however be shortened by the addition of very specific chemicals, such as, aluminum pyorgenic powder instead of aluminum powder. At the same time however, operational safety is affected.

It is therefore not possible to ignite and distribute a conventional hexachloroethane fog packing with an explosive load without significantly influencing the fog producing capabilities. Firstly, the time of action of the ignition flame is too short, and secondly, the reaction components are distributed before they can react with one another. Additionally, the use of an explosive leads to difficulties with respect to the operational safety and storage.

Compression of conventional mixtures of hexachloroethane and metal powder leads to such an activation that the reaction partners react incompletely with one another. This procedure however leads to a deactivation during storage and is the reason for the non-compressibility of conventional hexachloroethane packings.

The abovementioned disadvantages render it difficult to employ hexachloroethane fog producing packings in devices in which the sudden formation of a fog marking is important, such as is the case with a practice war head.

BRIEF DESCRIPTION OF THE DRAWING

The drawing is a cross-sectional view of a practive war head.

SUMMARY OF THE INVENTION

In accordance with the present invention, these disadvantages in a practice war head can be overcome by using a fog producing packing based on halogen carbon or halogen carbohydrate substances and reactive metal or metal oxide powders which is not compressed, but is placed in the practice war head in loosely shaken form. The fog producing packing is compressed upon impact and penetration of the practice war head into the ground by means of appropriate provision made in the war head and a working together of elements thereof, so that the packing is available in highly active condition. This is achieved, in essence, by arranging at least that closure element, which encloses the fog producing packing in an annular volumn defined by an outer tubular jacket and an inner dividing tube at the head end of the war head so as to be displaceable towards the fog producing packing. A further closure element is provided in the annular volume to enclose the packing at the base end of the war head. Both closure elements can however be displaceable towards the fog producing packing. The end of the nose section of the head of the artillery rocket facing the packing may, if desired, take over said function of the closure element in the annular space at the head end, by suitable arrangement of the connections of the head to the outer jacket and to the inner dividing tube.

DESCRIPTION OF THE PREFERRED EMBODIMENT

The fog producing packing closure elements are preferably annular discs which are located in the annular volume to either side of the packing. Fixing of said annular discs can best be effected on the inner dividing tube by means of suitable spring clip rings. The dividing tube preferably consists of a relatively strong walled steel tube having a barrier action which has a wall thickness of about 1.8 to 2.6 mm, preferably 2.2 mm. The portion of the inner dividing tube which contacts with the fog producing packing is preferably provided with ignition apertures, which are advantageously towards the lower end thereof. Four such openings are generally regarded as sufficient. The fog producing packing can, however, be caused to react by the heat which results only from the burning of the ignition substance in the dividing tube, if desired.

A free space should preferably exist between the bottom of the skirt section of the head and the head end surface of the fog producing packing. The ignition substance located in the inner dividing tube should preferably reach into the centre of the head above said head end surface of the packing so that the ignition substance can cause the dividing tube to burst open in the region of said free space and in the centre of the head so that the skirt section of the head can thus be displaced into the annular space to seal off the fog producing packing or vice versa. The ignition substance in the dividing tube can reach below the bottom end surface of the fog producing packing in the annular volume. This aspect is, however, not considered to be of particular significance to the functioning of the above practice war head device.

Fog producing substance and/or ignition substance are conveniently provided in the thin walled containers, since in this manner they can be easily dispensed and packed in determined amounts. For accommodating possible differences in volume which may take place in view of different granule sizes and weights of the fog producing or ignition substances, suitable materials, such as, foam materials or the like can be provided for achieving an equilibrium when filling containers. The containers are preferably of metal and are conveniently produced from aluminium.

Important for the proper functioning of the above practice war head is the inclusion of a fast reacting ignition substance having strong gas formation. Also important is that the amount of ignition substance in comparison with known devices of the above type is very high, and the proportion by weight of ignition substance to fog producing substance is in general about 1:5 and preferably 3:8. Fog products substances based on hexachloroethane, zinc, zinc oxide and aluminium are preferred. The ignition substance is conveniently one comprising metal powders and oxygen donators. Preferably such the initiator consists of barium nitrate and magnesium.

For purposes of ignition, an igniter core is provided in the ignition substance, most preferably consisting of nitrocellulose powder. Ignition is commenced by an impact detonator located on the head of the rocket. The ignition of the fog producing substance takes place at the same time as the compression thereof which results when the rocket is fired and activation by a similarly fast acting pyrotechnical substance which leads to the thus activated so-activated fog producing substance reacting in an explosive fashion.

The ignition substance employed in the above practice war head is preferably the same as employed in the fog war head (LAR) DM15, namely the LAR decomposition material with ignition core and ignition transfer DM1001. The fog producing substance is most preferably that which is also employed in the fog hand grenade DM15. Both devices are described on page 96 of the magazine "WEHRTECHNIK 4/77." The impact detonator is one of conventional structure. Only a fraction of the fog producing substance is converted when the above practice war head for artillery rockets is exploded when standing. The hole which is formed in the ground was attributed only to the action of the ignition substance. Only upon flight with following impact on the ground (at a penetration speed of about 260 m/sec.) did a substantially higher conversion of fog producing substance take place as compared to explosion when standing. Similarly, at impact, the sound of the explosion was considerably louder, a 1 to 2 m flame could be observed above the ground, and the hole formed in the ground was considerably larger. The cause of this action is regarded as being a combination of the time of penetration, rate of reaction of the decomposition material, provision of apertures in the inner dividing tube, fog producing substance surrounding the decomposition material, thin wall of the outer jacket and speed of impact of the rocket.

One preferred form of the above practice war head for artillery rockets will now be described with reference to the accompanying drawings. The drawings shows an impact detonator 1 mounted on the nose end of the rocket, located by being mounted in a hollow frusto-conical head element 3. The head element 3 has a hollow skirt section 5, to the bottom of which a thin walled tubular outer jacket 7 of steel is connected. In the centre 9 of the head element 3, there is provided a central tubular dividing element 13 of comparatively thick walled steel mounted concentrically within the tubular jacket 7, within which dividing element there is provided an ignition core 19 and fast reacting ignition substance 21 having strong gas formation properties, preferably based on metal powders and oxygen donators and particularly consisting of barium nitrate and magnesium. A fog producing substance 17 based on carbon halogen or halogen carbohydrate compounds and a reactive metal and/or metal oxide powder are loosely packed into the annular volume 15 defined between the outer jacket 7 and dividing element 13. The fog producing substance is contained in an aluminium container 35. The ignition substance 21 is also contained in an aluminium container 37.

At the base end 23 and nose end 25 of the fog producing substance 17, closure elements 27 and 29 are provided, which in the drawing are each displaceable towards the fog producing substance. The closure elements are in the form annular discs 39 and 41 and are located in position by means of spring clip rings 43 and 45 fixed to the tubular dividing element 13 to the sides of discs outwardly of the fog producing substance 17. In the drawing, the ignition substance 21 in the dividing element 13 reaches into the central portion 9 of the head element 3 above the nose end 25 of the fog producing substance located in the annular volume.

Reference numerals 31 and 33, respectively, refer to connection points between the skirt section 5 of the head element 3 and the outer jacket 7 and the central portion 9 of the head element 3 and the tubular dividing element 13. Between the skirt section 5 of the head element 3 and the nose end 25 of the fog producing packing 25 or the adjacent closure element 29, an annular free space 47 is defined. This free space 47 enables the ignition substance to burst open the tubular dividing element 13 in the adjacent region to form a mushroom closure leading to a sealing off of the fog producing substance. In the drawing, the tubular dividing element 13 also reaches below the base 23 of the fog producing substance 17 located in the annular volume 15. The fog producing substance 17 consists particularly of hexachloroethane, zinc, zinc oxide and aluminium, whilst the ignition core 19 consists of nitrocellulose. The ratio by weight of fog producing substance 17 to ignition substance 21 in this construction is about 3:8. The tubular dividing element 13 is provided with four apertures 11 in the region adjacent the base portion of the fog producing substance 17, spaced at angles of 90° from one another.

The practice war head device will normally have a diameter of about 110 mm.

The functioning of the above practice war head artillery rocket device is as follows:

Upon impact and penetration of the rocket with the ground, it is rapidly stopped, whereby the loosely packed fog producing substance 17 is suddenly compressed and the impact detonator 1 ignites the ignition core 19, which is immediately behind the detonator, at the same time. A high explosion pressure arises in the ignition substance 21 by virtue of the barrier effect of the tubular dividing element 13, which results in mushroom bursting of the front section of the dividing element and a moving forward of the entire base portion of the rocket comprising the fog producing substance 17 against the bottom of the skirt section 5 of the head element 3 so that this displaces the disc 41 rearwardly. At the same time, as a result of the sudden deceleration of the rocket, the disc 39 is displaced forwardly so that the metal container 35 is collapsed together and the fog producing substance 17 compressed and thus strongly activated. During this mechanical procedure, the ignition substance 21 is ignited and by virtue of the head transmitted (by the relatively high amount of ignition substance 21) and the apertures 11, the desired reaction takes place in an explosive fashion.

What we claim is:

1. In a practice war head device for an artillery rocket composed of a frusto-conical head element having a hollow nose section and a hollow skirt section having a base, an impact detonator mounted in said nose section, a tubular jacket connected to the skirt section, a tubular dividing element concentric with the tubular jacket together defining an annular volume, a fog producing substance based on a carbon halogen or halogen carbohydrate substance and reactive metal or metal oxide powders in said annular volume, and an ignition core of a quick-reacting ignition substance capable of high gas formation in the tubular dividing element, the improvement which comprises said fog producing substance being loosely packed in the annular volume, and wherein closure elements closing off said annular volume are provided at the nose side and base side of the annular packing, at least the nose side closure element is displaceable towards the fog producing substance packing, and the connection between the skirt section of the head element and the tubular jacket, the connection between the central portion of the head element and the tubular dividing element, and the base of the skirt section, are constructed so that upon impact of the war head device, the base of the skirt section and nose side closure element will be displaced into the annular volume to thereby compress the fog producing substance against the base side closure element.

2. The practice war head device according to claim 1 wherein each of the closure elements at the base side and nose side of the fog producing substance packing are displaceable in the annular volume towards the packing.

3. The practice war head device according to claim 1 wherein the closure element at the base side of the fog producing packing is immovably fixed in place in the annular volume and the closure element at the nose side of the fog producing packing is displaceable in the annular volume towards the packing.

4. The practice war head device according to claim 1 wherein the closure element at the nose side of the fog producing packing is fixed to the base of the skirt section of the head element.

5. The practice war head device according to claim 1 wherein the closure elements are annular discs and are located in place by means of locating elements at the sides of said annular discs outwardly of the fog producing packing.

6. The practice war head device according to claim 5, wherein the annular discs are each located in place by means of spring clip rings fixed to the tubular dividing element.

7. The practice war head device according to claim 1 wherein the tubular dividing element has a relatively thick wall so as to create a barrier effect on the ignition substance contained therein.

8. The practice war head device according to claim 1 wherein the portion of the tubular dividing element which is in contact with the fog producing substance is provided with apertures.

9. The practice war head device according to claim 1 wherein the nose side of the fog producing packing and the base of the skirt section of the head element define a free space therebetween.

10. The practice war head device according to claim 1 wherein the ignition substance contained in the tubular dividing element reaches into the central portion of the head element above the nose side end of the fog producing substance packing.

11. The practice war head device according to claim 1 wherein the ignition substance contained in the tubular dividing element reaches beneath the base side end of the fog producing substance packing.

12. The practice war head device according to claim 1 wherein the ignition substance and fog producing substance are contained in thin walled containers.

13. The practice war head device according to claim 12 wherein the containers are metal.

14. A practice war head device according to claim 13 wherein the containers are aluminium.

15. The practice war head device according to claim 1 wherein the ratio by weight of ignition substance to fog producing substance is about 1:5.

16. The practice war head device according to claim 1 wherein the ratio by weight of ignition substance to fog producing substance is about 3:8.

* * * * *